United States Patent [19]

Val Verde

[11] 4,077,331

[45] Mar. 7, 1978

[54] CARGO RACK

[75] Inventor: Emanuel Val Verde, Chicago, Ill.

[73] Assignee: Transco Inc., Chicago, Ill.

[21] Appl. No.: 691,369

[22] Filed: Jun. 1, 1976

[51] Int. Cl.[2] ..... B61D 17/00

[52] U.S. Cl. ..... 105/463; 280/147; 296/3; 296/35 A; 105/380

[58] Field of Search ..... 105/380, 382, 385, 386; 280/143-149; 211/184, 189; 296/3-9, 35 R, 35 A, 36

[56] References Cited

U.S. PATENT DOCUMENTS

| | | | |
|---|---|---|---|
| 308,802 | 12/1884 | Roberts et al. | 280/143 |
| 860,029 | 7/1907 | Irwin | 105/380 |
| 907,183 | 12/1908 | Seaman | 105/380 |
| 1,730,777 | 10/1929 | Mayer | 280/144 |
| 2,539,809 | 1/1951 | Buckley | 211/184 |
| 3,173,708 | 3/1965 | Machielse et al. | 296/3 X |
| 3,540,384 | 11/1970 | Charles | 105/380 X |
| 3,661,420 | 5/1972 | Swanson et al. | 105/380 X |
| 3,753,591 | 8/1973 | Pratt | 296/35 A |
| 3,841,695 | 10/1974 | Woodward | 105/390 X |

*Primary Examiner*—Robert J. Spar
*Assistant Examiner*—Donald W. Underwood
*Attorney, Agent, or Firm*—Edward C. Threedy

[57] ABSTRACT

A freight-retaining device consisting of a rack removably attached to a freight-hauling vehicle, such as a flat-deck railroad car, with the rack providing a plurality of vertically extending freight-retaining fingers adjustably spaced throughout the longitudinal length of the rack.

4 Claims, 5 Drawing Figures

CARGO RACK

SUMMARY OF THE INVENTION

To facilitate the securement of pipes, rods, structural angles, and sheet plates, as well as elongated metal parts, onto a freight-hauling vehicle, such as a flat car, there is provided a retaining system consisting of a plurality of vertically extending fingers adjustably mounted longitudinally of a fixed rack removably attached to the vehicle. The system offers more versatility to shippers, while assuring safer loads and fewer damage claims.

The system permits a standard flat car to be readily equipped to handle such loads that normally require the use of gondola type equipment. The utilization of such an equipped flat car gives the advantage of permitting quicker loading and unloading, all to the benefit of shippers. The system consists of a cargo finger rack providing an elongated base adapted to be placed upon the existing deck of a flat car in a direction transversely of the longitudinal length thereof. The base provides at each end an end riser fixedly attached to the base, with the riser having a depending portion extending into sockets carried by the side sill structure of the flat car. The end risers are then removably attached in the sockets, attaching the rack upon the deck of the flat car. A series of upstanding fingers may then be attached to the rack at selected positions along its length to accommodate freight of various shapes and sizes.

GENERAL DESCRIPTION

The invention will be best understood by reference to the accompanying drawings, in which there is shown the preferred form of embodiment of the invention by which the objects thereof are achieved, and in which.

It is the purpose of this invention to provide a cargo rack which is adapted to be removably positioned upon the flat deck of a flat car. The cargo rack is adapted to extend transversely of the longitudinal deck of the flat car and, as such, may be positioned upon the deck as is required.

Figure 1:
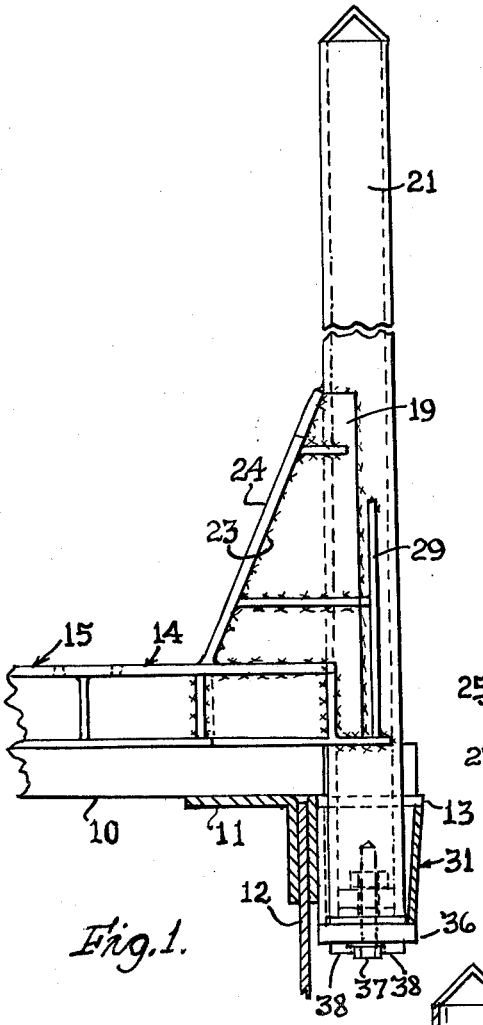
FIG. 1 is a fragmentary detailed sectional side view of one end riser of the cargo rack.
Figure 2:
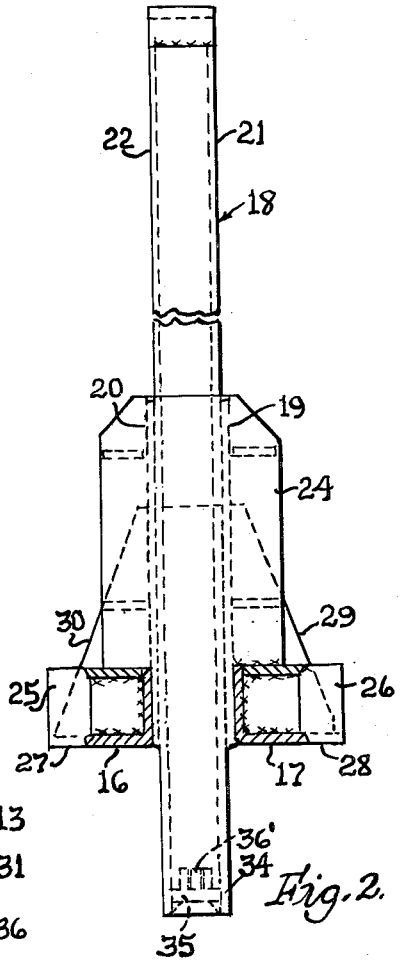
FIG. 2 is a detailed sectional end view similar to FIG. 1.

As shown in FIG. 1, the flat car provides a deck 10 which terminates along each of its longitudinal side edges in an angled end plate 11 welded upon a depending side plate 12 which in turn supports an angled sill 13. The rack 14 of the invention consists of a base structure 15 formed from a pair of channel members 16 and 17 adapted to be placed in spaced relation with respect to each other, with their open channels facing in opposite directions as shown in FIG. 2. At either end of the base structure 15 there is positioned within the space between the channel members 16 and 17 a portion of an end riser 18. To secure the end riser 18 to the base structure 15, there is provided a pair of face plates 19 and 20, each of which is welded to the opposite sides 21 and 22, respectively, of the end riser 18, as shown in FIGS. 1 and 2. It should also be noted that the face plates 19 and 20 are of such length as to extend into the space between the channel members 16 and 17 and, in turn, be welded thereto.

To restrain longitudinal as well as lateral displacement of the end riser 18 relative to the base structure 15, there is provided the following connecting structural support elements. The face plates 19 and 20 each provide an inclined edge 23 facing inwardly of the base structure 15 and upon which is welded a strut plate 24. This strut plate has its opposite ends welded to the top edge portions of the channel members 16 and 17 and the inner face of the end riser 18, as shown in FIGS. 1 and 2. As seen in FIG. 1, each of the channel members 16 and 17 has its end closed by an angle iron 25 and 26, respectively. Adapted to be connected to the horizontal flange 27 and 28 of each of the angle irons 25 and 26, respectively, is the base edge of a pair of triangularly shaped vertical support plates 29 and 30. The long edge of each of these plates 29 and 30 is in turn welded to the opposite face 21 and 22 of the end riser 18, as shown. By the foregoing arrangement, the rack 14 is provided at either end with a stationary rigid end riser by which the base structure 15 may be mounted upon the flat deck of the vehicle.

Figure 5:
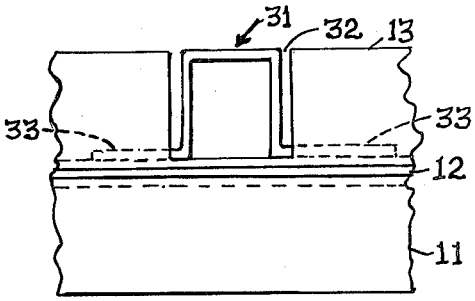
FIG. 5 is a fragmentary detailed view of one of the stake sockets provided by the vehicle.

As noted in FIGS. 1 and 2, the end riser 18 is of such length as to extend beyond the bottom of the base structure 15, as well as of such length as to project into a socket 31 provided by the side sill 13 of the freight car. The socket 31 is of a well known construction and, as such, is shown in FIG. 5. In such illustration there is shown the end angle 11, the side plate 12, and the sill 13. The horizontal flange of the sill 13 is provided with a cut-out 32 beneath which is positioned the socket 31. The socket 31 is of a stirrup construction and provides side legs 33 which are adapted to be welded upon the depending flange of the sill 13. When the end riser 18 is placed therein, the lowermost end portion 34 thereof will project into the socket 31.

As noted in FIGS. 1 and 2, there is positioned within the end riser 18 adjacent the lower end portion 34 thereof a retaining washer 35 which fixedly carries on the inner face thereof a locking nut 36'. After the riser 18 has been placed within the socket 31, a retaining plate 36 has a bolt 37 threaded therethrough, through the fixed washer 35, and into the nut 36' within the hollow end 34 of the riser 18.

The retaining plate 36 is of a size greater than the opening of the socket 31, such that it cannot pass therethrough. As the bolt 34 is fastened, it will connect the riser 18, as well as the rack 14, onto the freight car. To prevent the bolt 34 from turning, due to vibration during transit of the freight car, retaining bars 38 may be placed against opposite sides of the bolt head 37 and spot-welded to the plate 36 to retain the bolt 34 in such fastened position.

Adapted to be mounted onto the rack 14 intermediate the end risers 18, and spaced in any convenient manner, are a series of freight-retaining fingers 39. These retaining fingers 39 consist of an upright post 40 adapted to sit upon a base plate 41 which is of a width equal to the combined length of the upper arms of the channel members 16 and 17 plus the space therebetween, so that it is securely positioned onto the rack 14.

Figure 4:
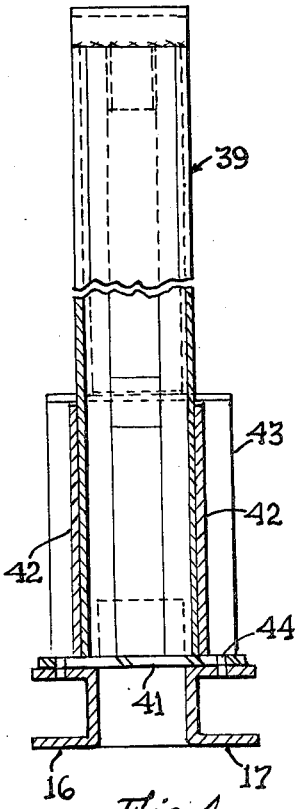
FIG. 4 is a fragmentary detailed sectional end view similar to FIG. 3.
Figure 3:
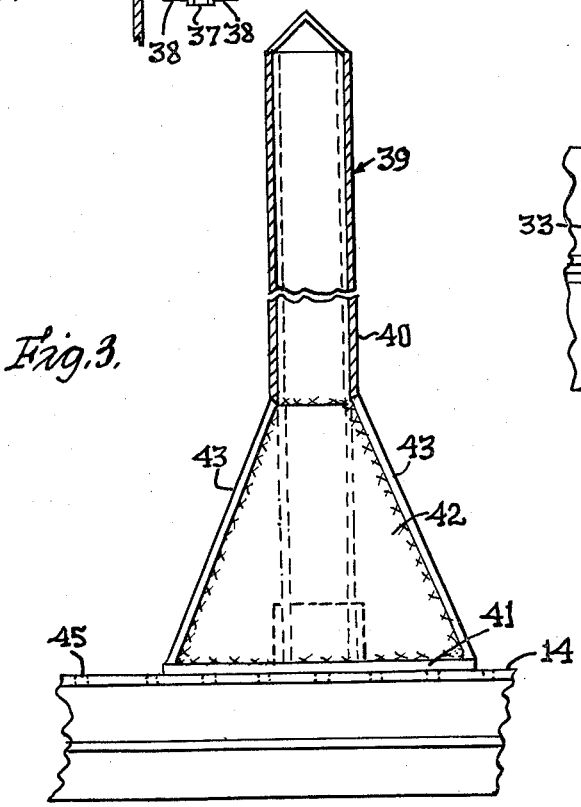
FIG. 3 is a fragmentary detailed side sectional view of one of the movable fingers associated with the cargo rack.

To secure the finger 39 in an upright position with respect to its base plate 41, there are provided a pair of side plates 42 which are truncated so as to provide opposite inclined side edges. Mounted upon the opposite side edges are a pair of supporting struts 43. Both the struts 43 as well as the side plates 42 are welded upon the base plate 41. By this construction there is provided a rigid base structure for the fingers 39. The base plate 41 is provided with a plurality of openings 44 formed therethrough, which are adapted to register with like openings 45 formed in the upper arms of the channel members 16 and 17, as shown in FIGS. 3 and 4. By this arrangement the fingers 39 may be placed anywhere upon the rack 14 and, by suitable nuts and bolts, fastened thereto so as to be positioned to accommodate the various sizes and structural shapes of the freight to be retained thereby.

From the foregoing, it is apparent that I have described a cargo rack which may be readily attached to a standard freight car having a flat deck, with the cargo rack providing for the positioning of individual freight-retaining fingers at various locations along the longitudinal length of the rack. By this structure the objects of the invention are achieved.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A cargo rack system for use upon a flat deck of a railroad car that provides along its vertical edges vertical stake sockets, comprising a. an elongated rack having a base structure of a length greater than the width of the car and adapted to be removably carried upon the flat deck of the car so as to extend beyond the opposite longitudinal edges thereof, b. said base structure providing a horizontal top and bottom surface and a fixed pair of tubular risers at opposite ends thereof, with said risers being of a length to provide portions extending above and below said base structure and the flat deck of the car, c. means fixedly connecting said end risers to said base structure whereby a portion of each riser projects into the stake sockets provided along the longitudinal edges of the car, d. means for removably connecting said end risers in the stake sockets so as to mount said rack across the flat deck of the car, e. a plurality of vertically extending freight-retaining fingers each providing a horizontal base plate adapted to be supported by said top surface of said base structure, and f. means for removably mounting said base plates of said fingers on said base structure to place said fingers in preselected positions longitudinally of said rack between said fixed end risers.

2. A cargo rack system as defined by claim 1, wherein said means for removably connecting said end riser in the stake socket provided by the railroad car, comprises a retaining plate of a size greater than the opening of the socket, with said plate adapted to be positioned therebeneath and threadably attached to the bottom of said end riser disposed in the socket so as to removably connect the same therein.

3. A cargo rack system as defined by claim 1, wherein said means for removably mounting said fingers on said base structure comprises nut and bolt assemblies adapted to be projected through corresponding apertures formed in said top surface of said base structure and through said base plates of said freight-retaining fingers.

4. A cargo rack system as defined by claim 3, wherein said means for removably connecting said end riser in the stake socket provided by the railroad car, comprises a retaining plate of a size greater than the opening of the socket, with such plate adapted to be positioned therebeneath and threadably attached to the bottom of said end riser disposed in the socket so as to removably connect the same therein.

* * * * *